US007784113B2

(12) United States Patent
Ragan et al.

(10) Patent No.: US 7,784,113 B2
(45) Date of Patent: Aug. 31, 2010

(54) GLOVE CONSTRUCTION AND METHOD OF MAKING SAME

(75) Inventors: Thomas G. Ragan, Germantown, TN (US); Larry C. Deal, Hot Springs, AR (US)

(73) Assignee: Shelby Group International, Inc., Memphis, TN (US)

( * ) Notice: Subject to any disclaimer, the term of this patent is extended or adjusted under 35 U.S.C. 154(b) by 978 days.

(21) Appl. No.: 11/070,373

(22) Filed: Mar. 2, 2005

(65) Prior Publication Data

US 2006/0195969 A1 Sep. 7, 2006

(51) Int. Cl.
*A41D 19/00* (2006.01)

(52) U.S. Cl. ..... 2/164; 2/159

(58) Field of Classification Search ..... 2/158–170
See application file for complete search history.

(56) References Cited

U.S. PATENT DOCUMENTS 3,014,980 A * 12/1961 Marshall et al. ..... 174/121 R
4,370,365 A * 1/1983 Takamizawa et al. ..... 427/387
4,454,611 A 6/1984 Tschirch et al.
4,733,413 A * 3/1988 Dykstra ..... 2/169
4,847,918 A 7/1989 Sturm
5,020,162 A 6/1991 Kersten et al.
5,088,124 A 2/1992 Dutchik
5,349,705 A * 9/1994 Ragan ..... 2/161.6
5,566,405 A 10/1996 Masley
5,603,119 A 2/1997 Rinehart
5,822,796 A 10/1998 Harges, Jr. et al.
5,851,683 A 12/1998 Plamthottam et al.
6,154,886 A 12/2000 Hottner
6,155,084 A 12/2000 Andrews et al.
6,243,875 B1 6/2001 French
6,591,427 B1 7/2003 Bennett
6,637,035 B1 * 10/2003 Brinkmann et al. ..... 2/161.6
6,792,625 B2 9/2004 Hexels
2002/0073474 A1 6/2002 Geng
2003/0015275 A1 * 1/2003 Phillips et al. ..... 156/71
2004/0098786 A1 * 5/2004 Hottner et al. ..... 2/159
2007/0124849 A1 * 6/2007 Williams et al. ..... 2/275

FOREIGN PATENT DOCUMENTS

JP 2004051723 A * 2/2004

* cited by examiner

*Primary Examiner*—Shaun R Hurley
*Assistant Examiner*—Andrew W Sutton
(74) *Attorney, Agent, or Firm*—Julie R. Baldridge; Baker, Donelson, Bearma, Caldwell & Berkowitz, PC

(57) ABSTRACT

An improved glove construction wherein the trank, forchette and thumb components are stitched together at the outer periphery with the liner outside and a barrier layer inside to form a glove insert system with exterior seams; the insert system is then reversed to place the barrier layer outside, the liner inside and the seams inverted; a primer base is applied along the inverted seams and dried; an adhesive sealant is then applied along the inverted seams and cured. This reversed glove insert is then placed in side of and secured to an outer shell. A method to prevent liquid, chemical and viral ingress to a seam is also disclosed.

20 Claims, 6 Drawing Sheets

24
26
28
30
32
34
20
36a
20d
36
22
50
20a
20b
40
42
44

FIG. 2
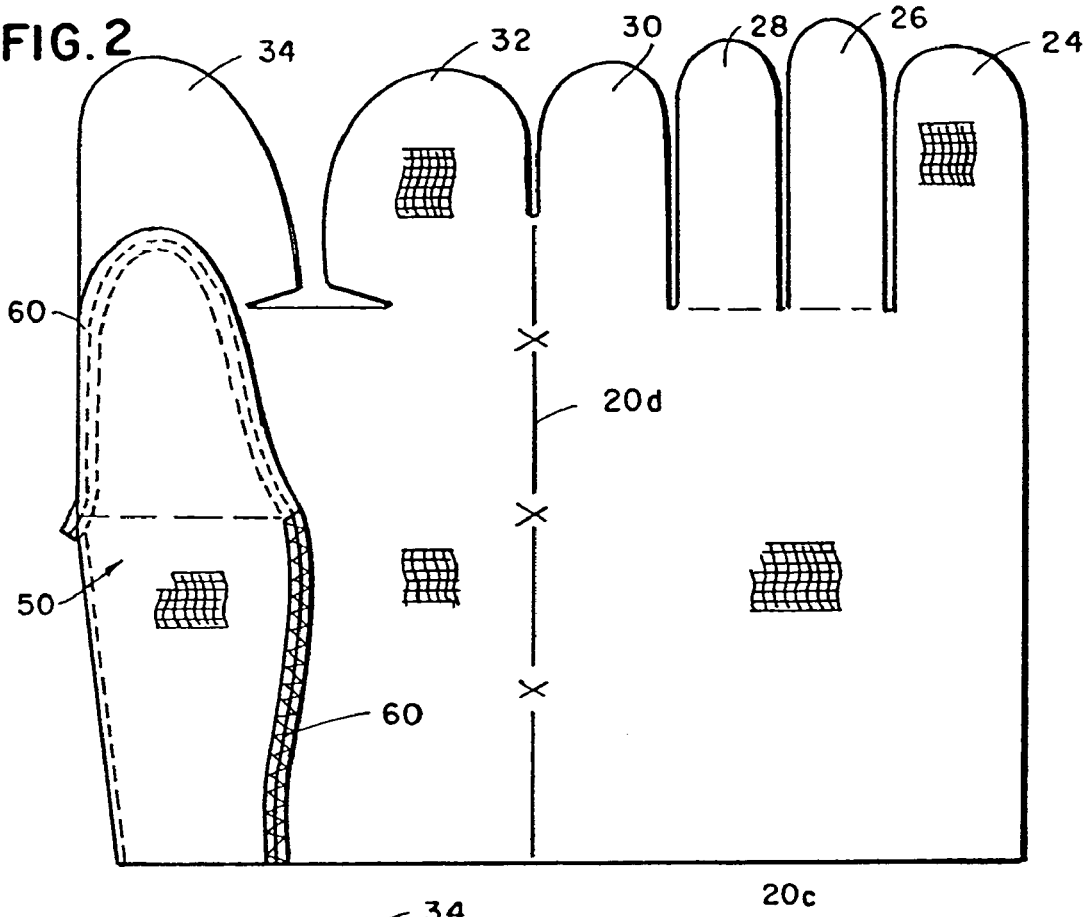
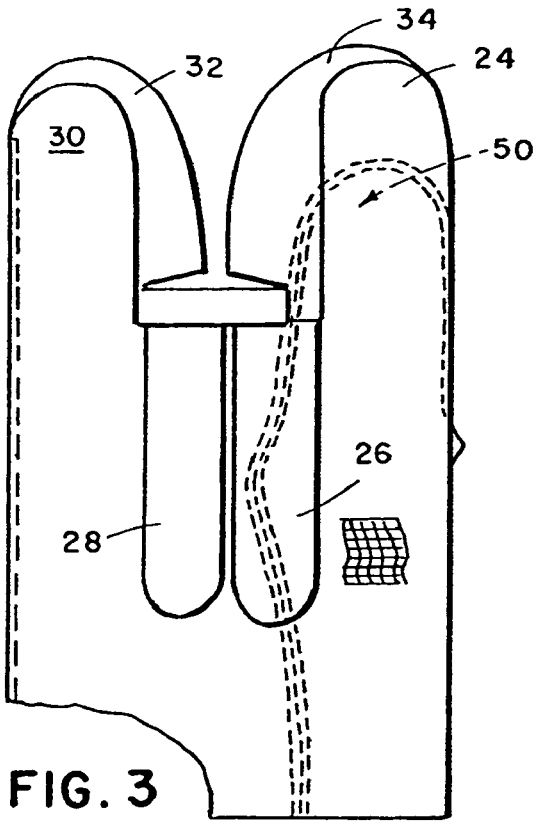
FIG. 3
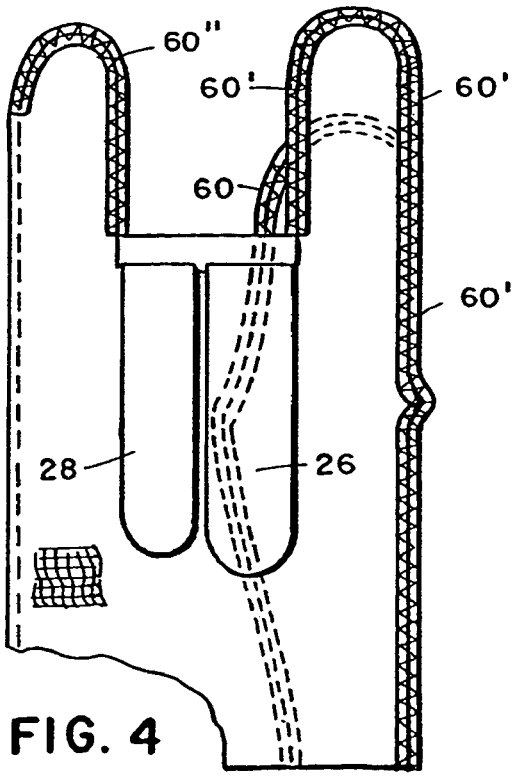
FIG. 4

60'
60'''
60'''
60''
60'
40

60
20c 40
20a
20b 20b
40
20a

60'''
60'''
60'
40
60''

60
20c

FIG. 10
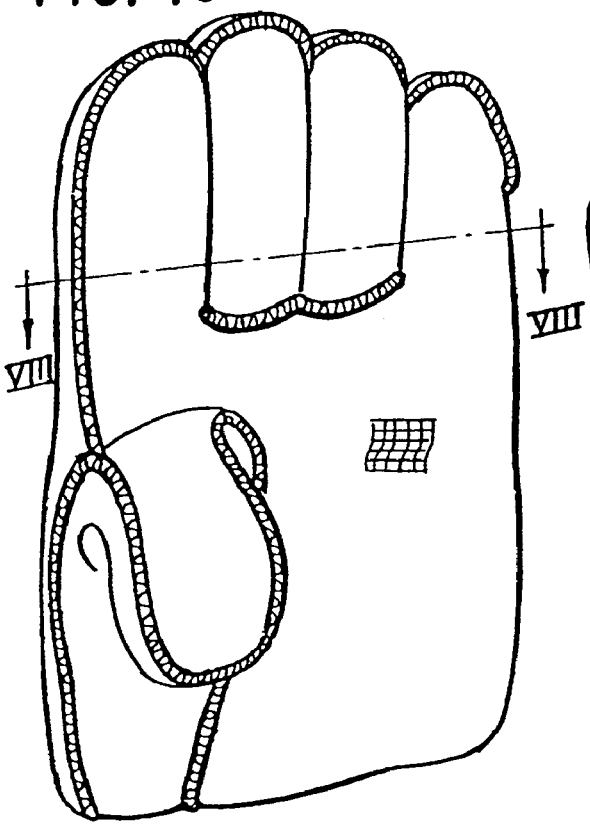
FIG. 11
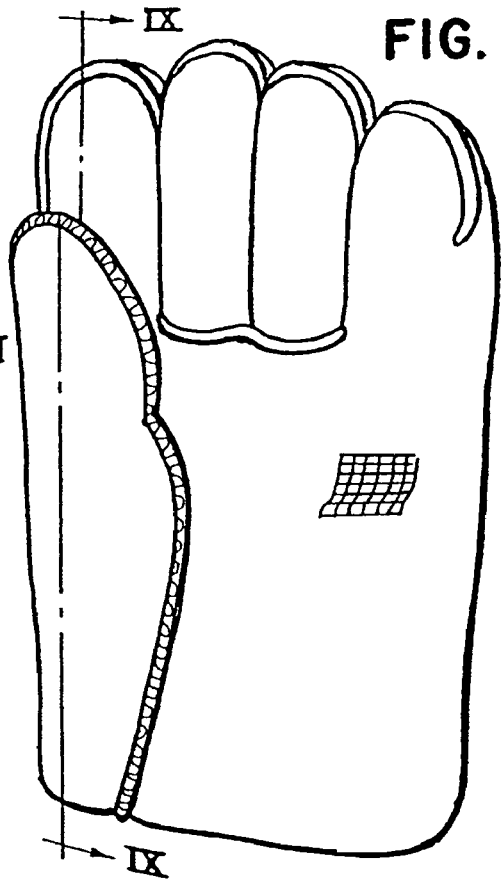
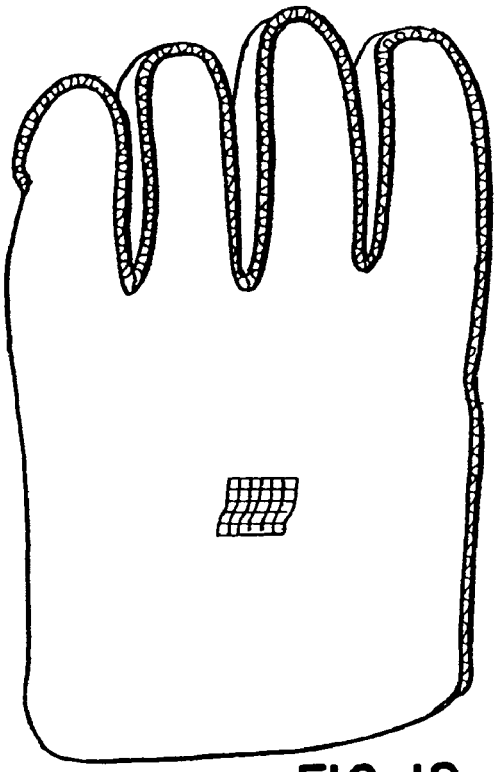
FIG. 12
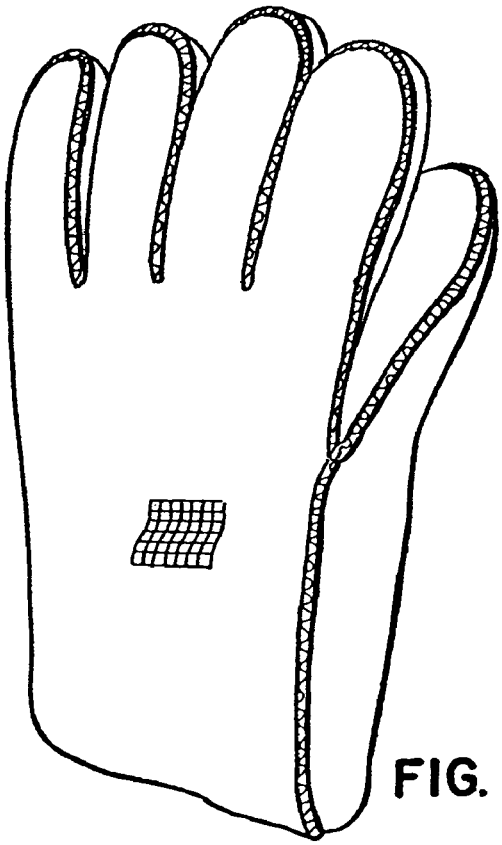
FIG. 13

GLOVE CONSTRUCTION AND METHOD OF MAKING SAME

RELATED APPLICATIONS

NOT APPLICABLE

STATEMENT REGARDING FEDERALLY SPONSORED RESEARCH OR DEVELOPMENT

NOT APPLICABLE

REFERENCE A "MICROFICHE APPENDIX"

NOT APPLICABLE

FIELD OF THE INVENTION

This invention relates to an improved glove manufacture, and more particularly to the manufacture of gloves employing a barrier layer which prevents liquid, chemical and viral ingress but allows moisture vapor egress and employing the use of a primer base and adhesive sealant which increase seam integrity to prevent liquid, chemical and viral ingress.

BACKGROUND OF THE INVENTION

Gloves employing barrier layers are generally known in the prior art, for example, U.S. Pat. Nos. 4,430,759; 4,520,056, and 4,545,841. In the construction of such gloves, the inventor has determined that it is advantageous to have the barrier layer peripherally stitched to the liner along seams. The present development enables the barrier/liner layer to be so stitched to form the glove insert system, but without the resulting seams serving as entry paths for liquid, chemical and viral ingress.

SUMMARY OF THE INVENTION

The present invention is an improvement to the glove construction set forth in U.S. Pat. No. 4,733,413. The present invention improves the durability of the glove by strengthening seam integrity to prevent liquid, chemical and viral ingress. The present invention discloses an improved glove construction that employs a barrier system which prevents liquid, chemical and viral ingress but allows moisture vapor transmission egress for gloves used by fire-fighters, EMS personnel, search and rescue personnel, law enforcement personnel and any other persons involved in similar situations requiring liquid, chemical and viral protection to the hands.

The present invention discloses a method of making a glove comprising: (a) providing trank, forchette, and thumb glove components, each having an inner liner and a barrier adhered to the inner liner, and providing a glove shell; (b) stitching the components together with the inner liner on the outside and the barrier on the inside to form an assembled glove insert system having protruding connecting seams between the components at the outer periphery of the insert system; (c) reversing the glove insert system to place the inner liner inside, the barrier outside, and the protruding seams inside, while creating elongated peripheral depressions along the exterior of the seams; (d) applying a primer base along the peripheral depressions of the seams, wherein the primer base comprises: a plurality of solvents, tetrapropyl orthosilicate and tetra(2-methoxyethoxy)silane; (e) applying an adhesive sealant along the peripheral depressions of the seams, and curing the adhesive sealant thereby sealing the seams to prevent liquid, chemical and viral ingress thereat while the barrier allows moisture vapor egress; and (f) securing the reversed seam sealed glove insert system inside the glove shell.

In the preferred embodiment, the inner liner is made of fleece. In the preferred embodiment, the reversed glove insert system is stitched to the glove shell. Additionally, in the preferred embodiment, the plurality of solvents comprises: light aliphatic petroleum solvent naphtha, xylene, and ethylbenzene. In the preferred embodiment, the adhesive sealant is applied as a bead spread along the inverted seams.

The present invention further discloses a glove comprising: an outer shell and an inner member system, the inner member system comprising an inner liner and an outer barrier laminated and then attached together along peripheral seams; the seams being inverted with the stitching on the inside of the inner member system and an elongated recess along the outside periphery; and a primer base applied in the elongated recess along the seams on the outside of the inner member; and an adhesive sealant applied in the elongated recess along the seams on the outside of the inner member system to prevent liquid, chemical and viral ingress thereat while the barrier allows moisture egress.

In the preferred embodiment, the primer base of the glove comprises a plurality of solvents, tetrapropyl orthosilicate and tetra (2-methoxyethoxy) silane. Additionally, in the preferred embodiment, the plurality of solvents comprises: light aliphatic petroleum solvent naphtha, xylene and ethylbenzene.

The present invention further discloses a method to prevent liquid, chemical and viral ingress to a glove or other article having an outer shell and an inner member system, the inner member preferably comprises a liner and a barrier adhered to the liner, the liner and the barrier are attached together along peripheral seams, the seams being inverted with the stitching on the inside of the inner member system and an elongated recess along the outside periphery, the method comprises: (a) applying a primer base along the elongated recess, wherein the primer base comprises a plurality of solvents, tetrapropyl orthosilicate, and tetra (2-methoxyethoxy)silane, and drying the primer base; and applying an adhesive sealant along the elongated recess, and curing the adhesive sealant thereby sealing the seam to prevent liquid, chemical and viral ingress thereat.

In the preferred embodiment, the plurality of solvents comprise: light aliphatic petroleum solvent naphtha, xylene and ethylbenzene.

The present invention discloses a method of making a glove comprising: (a) providing trank, forchette and thumb glove components, each having a liner and a barrier adhered to the liner; and providing a glove shell; (b) stitching the components together with the liner on the outside and the barrier on the inside to form an assembled glove insert system having protruding connecting seams between the components at the outer periphery of the insert system; (c) reversing the glove insert system to place the liner inside, the barrier outside, and the protruding seams inside, while creating elongated peripheral depressions along the exterior of the seams; (d) applying a primer base along the peripheral depressions of the seams, wherein the primer base comprises a plurality of solvents, tetrapropyl orthosilicate and tetra (2-methoxyethoxy) silane; (e) applying an adhesive sealant along the peripheral depressions of the seams, and curing the adhesive sealant thereby sealing the seams to prevent liquid, chemical and viral ingress thereat while the barrier allows moisture vapor egress; (f) reversing the glove insert system to place the liner outside, the barrier inside, the protruding seams outside, and the seam sealed peripheral depressions inside; and (g) securing the glove insert system inside the glove shell.

In the preferred embodiment, the liner is made of fleece. In the preferred embodiment, the glove insert system is stitched to the glove shell. In the preferred embodiment, the plurality of solvents comprises: light aliphatic petroleum solvent naphtha, xylene and ethylbenzene. In the preferred embodiment, the adhesive sealant is applied as a bead spread along the peripheral depressions of the seams.

The present invention further discloses a glove comprising: an outer shell and an inner member system, the inner member system comprising a liner and a barrier adhered to the liner, the liner and barrier being attached together along peripheral seams; the seams being inverted with the stitching on the inside of the inner member system and an elongated recess along the outside periphery in order to apply a primer base and an adhesive sealant; the primer base applied in the elongated recess along the seams on the outside of the inner member system; the adhesive sealant applied in the elongated recess along the seams on the outside of the inner member system to prevent liquid, chemical and viral ingress thereat while the barrier allows moisture egress; and the seams being inverted with the stitching on the outside of the inner member and the elongated recess along the inside periphery.

In the preferred embodiment, the primer base comprises: a plurality of solvents, tetrapropyl orthosilicate and tetra(2-methoxyethoxy)silane. The plurality of solvents comprises: light aliphatic petroleum solvent naphtha, xylene and ethylbenzene.

BRIEF DESCRIPTION OF THE DRAWINGS

FIG. 2 is an elevational view of the opposite side of the trank with the thumb attached.

FIG. 3 is an elevational view of the trank and attached thumb of FIG. 2, the trank folded at the seam indicated in FIG. 2, in preparation for stitching of the two outer fingers together.

FIG. 4 is an elevational view of the trank and thumb in FIG. 3, with the two outer fingers peripherally stitched.

FIG. 10 is a side perspective view of the glove insert system.

FIG. 11 is another perspective view of the glove insert system.

FIG. 12 is a back perspective view of the glove insert system.

FIG. 13 is another back perspective view of the glove insert system.

FIG. 15 is a perspective view of the totally reversed glove insert system, with barrier layer out and liner in.

Figure 18:
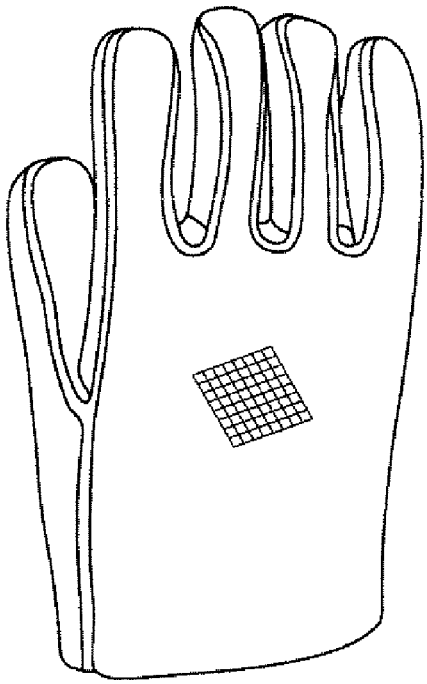
FIG. 18 is a back perspective view of the cured glove insert system.
Figure 20:
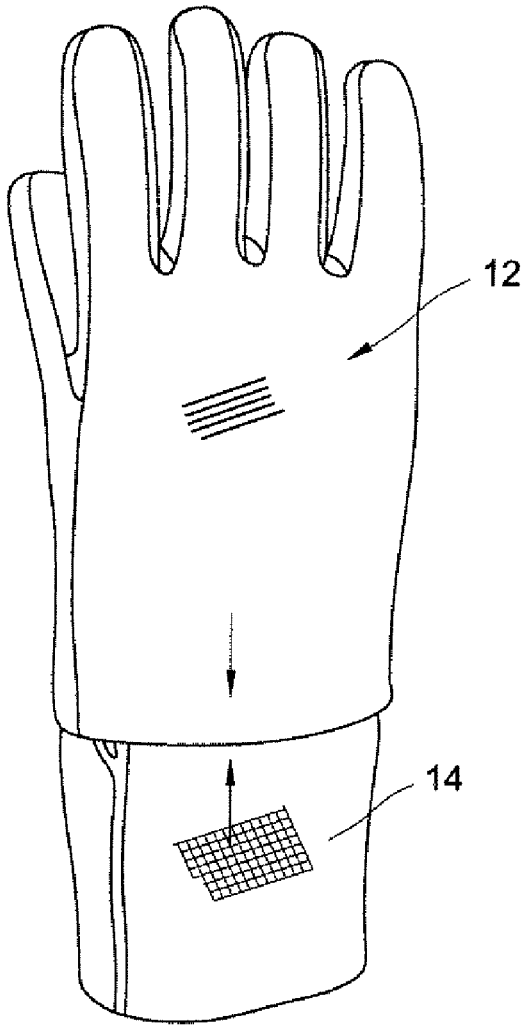
FIG. 20 is a perspective view showing the completed glove with the insert stitched to the glove shell.
Figure 19:
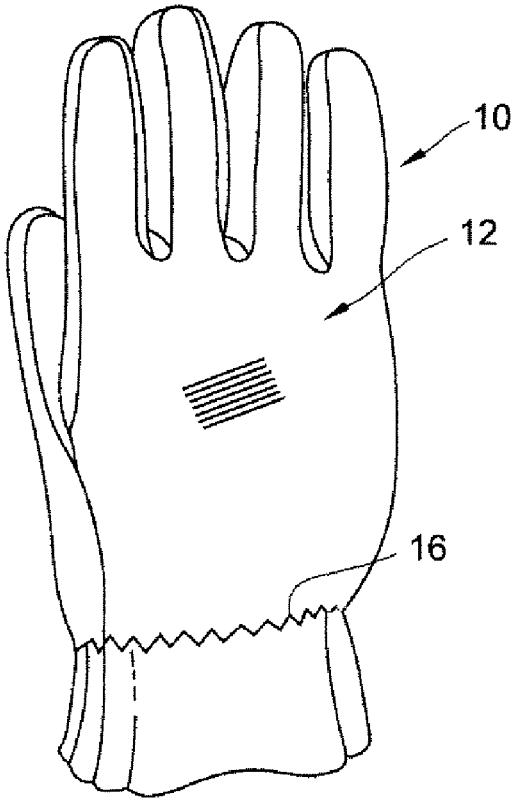
FIG. 19 is a perspective view showing the insertion of the reversed glove insert into a glove shell.

DETAILED DESCRIPTION OF THE INVENTION:

Referring now specifically to the drawings, the completed right hand glove 10, seen in FIG. 19, formed by the method herein is shown to include an outer shell 12 as of leather, fabric or the like, and an assembled insert system 14 which is inserted within the shell 12 as show in FIG. 18, and interconnected by stitching 16, seen in FIG. 19, and by stitching to tabs applied to the insert system 14 (not shown). This insert system 14 is specially assembled from the components depicted in FIG. 1, namely trank 20, forchette 40 and thumb 50. The thumb component 50 illustrated in the Figures is a straight thumb pattern glove, but any other glove pattern may be used, such as a wing pattern or keystone pattern, as desired by one of skill in the art.

Figure 1:
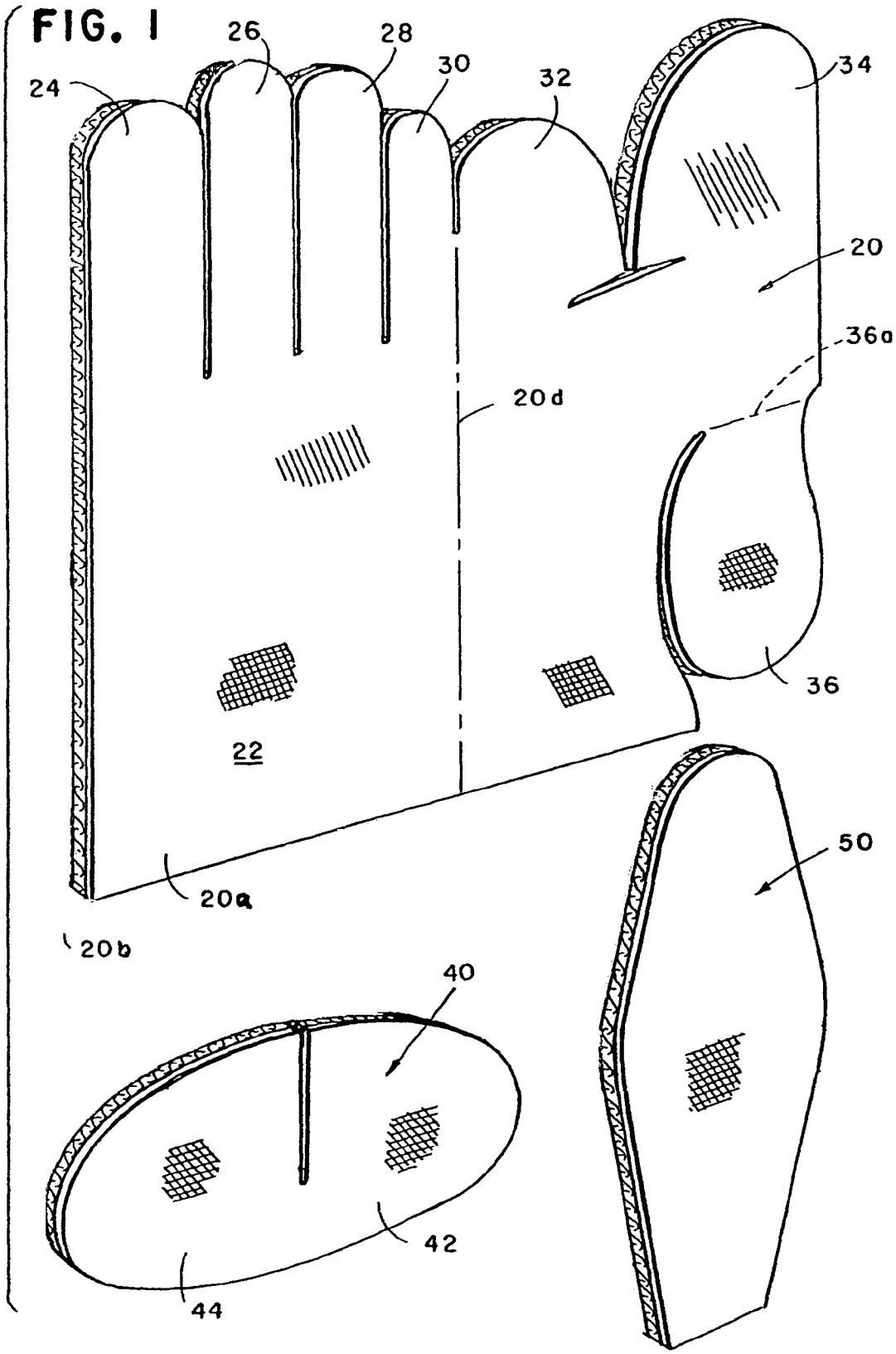
FIG. 1 is an elevational perspective view of the trank, forchette, and thumb components of a right hand glove insert, not showing the glove outer shell.

Referring to FIG. 1, trank 20 comprises a specially configurated element preferably formed of two layers, namely a barrier 20*a* which prevents liquid, chemical and viral ingress but is permeable to moisture vapor and air and a inner liner 20*b* contiguous to barrier 20*a*. The barrier 20*a* is preferably made of porous polytetrafluoroethylene ("PTFE"), but other materials may be used as desired by one of skill in the art. PTFE is a superior alternative to polyurethane or polyamide-based moisture barriers. PTFE, unlike the other materials, has an increased thermal stability which better prevents the barrier 20*a* from melting, degrading and leaking. The inner liner 20*b* is preferably a fleece, but other materials such as a thick porous cloth, natural or synthetic, which may or may not be woven, may be used as desired by one of skill in the art.

These two layers, barrier 20*a* and liner 20*b*, are interconnected as by adhesive in a continuous laminate and then die cut into the component configurations depicted in FIG. 1. Barrier 20*a* and liner 20*b* are flexible materials capable of being formed into the desired ultimate three dimensional configurations.

Referring now to FIGS. 1 and 2, trank 20 is depicted with a phantom line 20*d* separating the two halves of the trank 20. As set forth in FIG. 1, the left half of the trank 20 includes a lower back hand portion 22, a projecting pointer finger back flap 24, an adjacent middle finger back flap 26, a ring finger back flap 28 adjacent the middle finger back flap 26, and a little finger back flap 30 adjacent to the ring finger back flap 28. On the right half of the trank 20, there is immediately adjacent the little finger back flap 30 a wider little finger front wrap 32 and adjacent to that an index or pointer finger front wrap 34. Directly beneath the pointer finger front wrap 34 is a depending thumb back flap 36.

Forchette 40 includes two like symmetrical halves 42 and 44 forming the middle finger front wrap and right finger front wrap. Thumb 50 forms the thumb front wrap.

In fabrication of the glove insert, thumb 50 is attached to trank 20 by first bending the depending thumb back flap 36 upwardly along its transverse crease line 36*a* so that it lies alongside the pointer finger front wrap 34. Then thumb 50 is positioned contiguous thereto, followed by peripheral stitching around the thumb 50 and down to the base of the trank 20 as indicated by stitching 60, seen in FIG. 2. This forms a protruding peripheral seam.

Trank 20 is folded on the phantom line 20*d* with barrier 20*a* on the inside of the insert, i.e. the barrier on one portion facing the barrier on the other portion, while the inner liner 20*b* is on the outside.

After these portions of trank 20 are folded over one another on the phantom line 20*d* in the manner indicated, as shown in FIG. 3, pointer finger front wrap 34 is curled around and stitched to the pointer finger back flap 24, while little finger front wrap 32 is configurated and stitched to little finger back flap 30 in the manner indicated in FIG. 4 at stitching 60' and 60".

Figures 5, 6, 7, 8, 9:
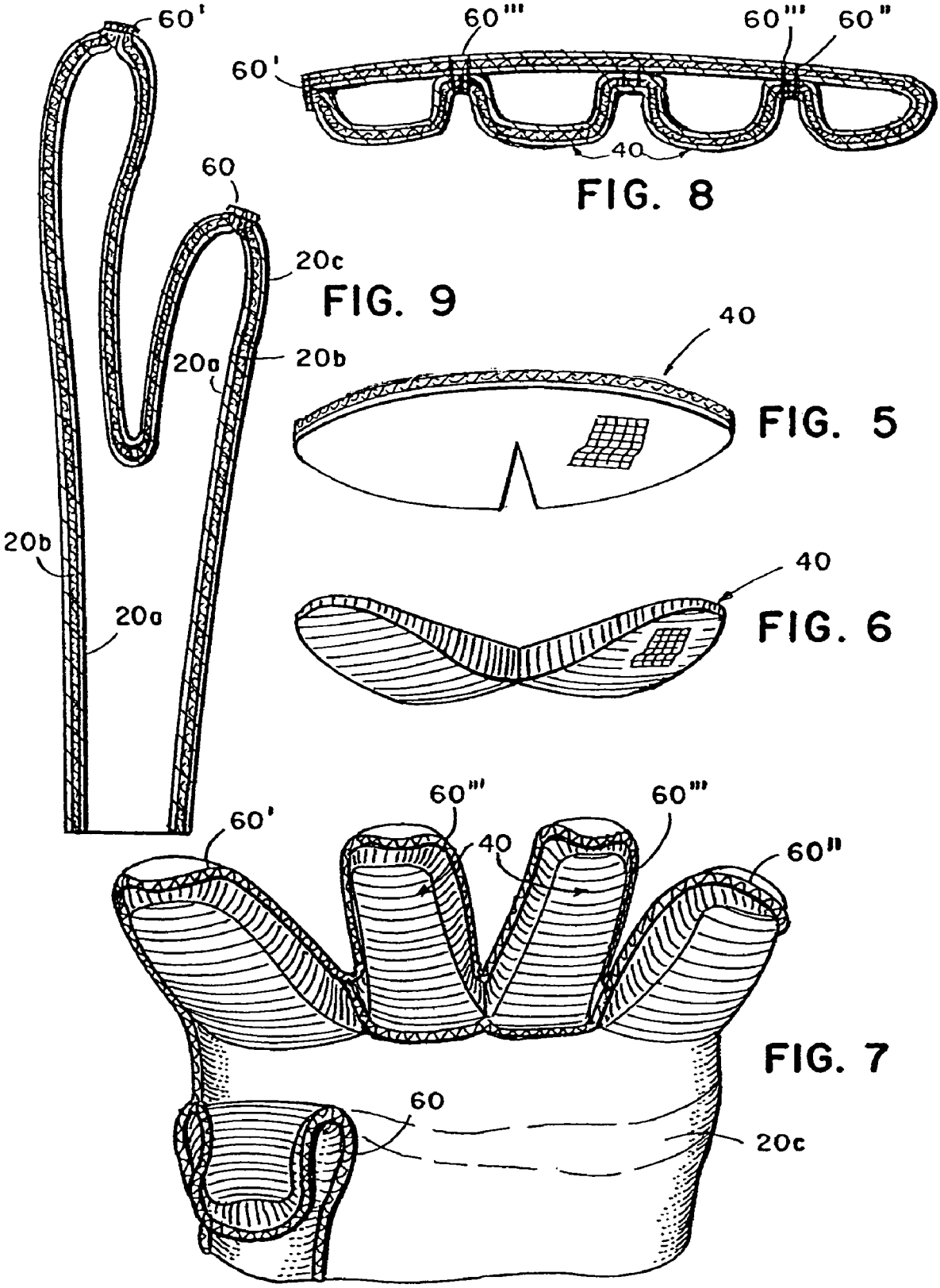
FIG. 5 is a perspective view of the forchette in its flat condition.
FIG. 6 is a perspective view of the forchette curled in order to be stitched to the two center finger flaps on the trank.
FIG. 7 is a perspective view of the glove insert with the forchette and thumb stitched to the trank.
FIG. 8 is a cross sectional view through the fingers of the glove insert system.
FIG. 9 is a longitudinal cross sectional view of the glove insert system.
Figure 14:
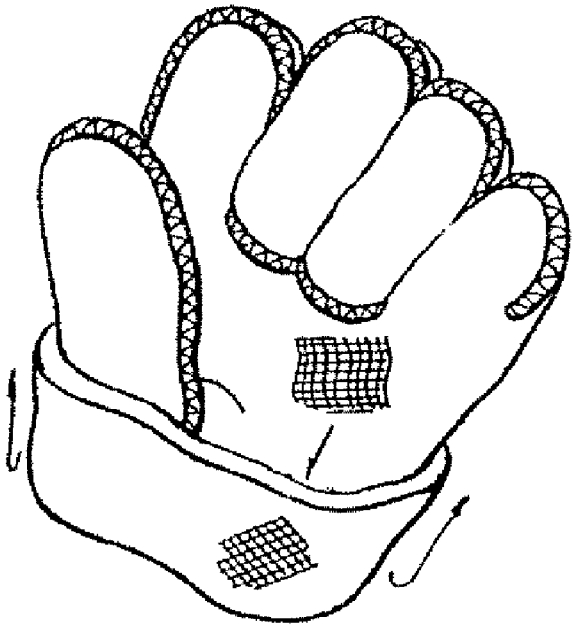
FIG. 14 is a perspective view showing the action of reversal of the glove insert system.
Figure 15:
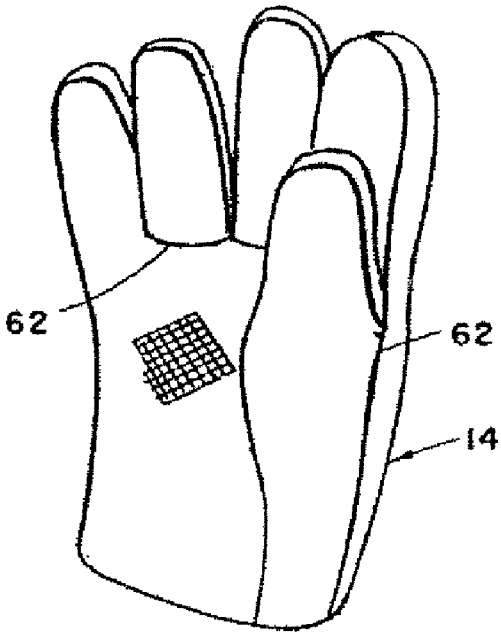
Figure 17:
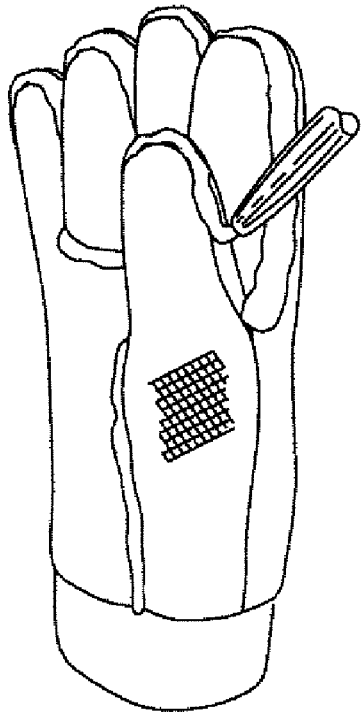
FIG. 17 is a perspective view showing the application of a bead of adhesive sealant into the elongated outside seam recess of the reversed seams.

Next, each half of forchette 40 is configurated so that it is altered from the appearance in FIG. 5 to that in FIG. 6, then placed against the back flaps 26 and 28 and peripherally sewn in place as shown by stitching 60'" in FIG. 7. At this time the components in FIG. 1 are interconnected, with the layer of stitching being exposed and protruding at the peripheral portions of the components, and with inner liner 20*b* being on the exterior while barrier 20*a* is on the inside of this glove insert system 14. The extent of the peripheral stitching is more clearly depicted in FIGS. 10 and 11. FIGS. 12 and 13 show the reverse or back side of the right hand glove insert and projecting stitched seams. At this point in the fabrication, the glove insert system 14 is reversed, i.e. by turning it inside out, as depicted at the initial stages in FIG. 14. This reversal places the barrier 20*a* on the outside, the inner liner 20*b* on the inside, the protruding stitching seams on the inside, and an elongated peripheral seam depression or recess 62 (FIG. 15) on the outside of the glove insert 14.

After the glove insert system 14 is reversed, a primer base is applied along the entire elongated peripheral seam depression 62, so as to be over the entire stitched length of the assembled glove components. The primer base increases the seam integrity of insert 14, and consequently the glove, by bonding to the adhesive sealant (described below) and allowing the adhesive sealant to adhere to the barrier 20*a*. The primer base is preferably made of a plurality of solvents, tetrapropyl orthosilicate and tetra(2-methoxyethoxy)silane, such as Dow Corning® 1200 RTV Prime Coat/Clear. The plurality of solvents include light aliphatic petroleum solvent naphtha, xylene and ethylbenzene. In the preferred embodiment, the primer base is applied to the seam depression area with a camel hair brush, but other fine strand brushes may be used as desired by one of skill in the art. After application, the primer base is then allowed to dry.

Figure 16:
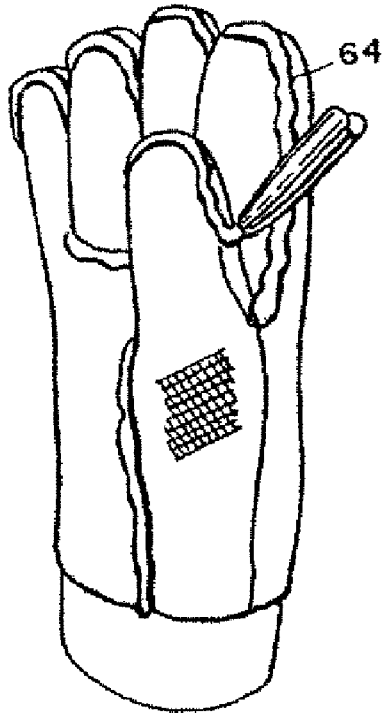
FIG. 16 is a perspective view showing the application of a primer into the elongated outside seam recess of the reversed seams.

Once the primer base has dried, an adhesive sealant is applied, as shown in FIG. 16, along the entire elongated peripheral seam depression 62 over the primer base, so as to be over the entire stitched length of the assembled glove components. The adhesive sealant is preferably made of suitable waterproof, curable polymeric sealant which will adhere to the primer base and barrier, such as 4.4 gallons of Dow Corning® 1890 Protective Grey Coating diluted with ½ gallon plus ½ pint of naphtha, applied as in bead form from a suitable applicator to form a sealing bead 64, as shown in FIG. 16. Preferably this bead fully and uniformly fills the depression and effectively seals it preventing liquid, chemical and viral passage. This adhesive sealant is preferably cured with heat and air flow for about two hours at a temperature of about 75° F., but the time will vary depending on the humidity in the air and the outside temperature. Thereafter, adhesive tabs (not shown) are applied to both ends of each finger and thumb portions of the completed insert 14. A portion of the adhesive tabs extends from the end of each finger and thumb portions allowing the tabs to be attached to shell 12. The completed insert 14, shown to be a right hand glove member, is inserted into a right hand shell 12, as shown in FIG. 18. The shell 12 is preferably made of leather, but other materials, such as fabric or the like, may be used as desired by one of skill in the art. The leather is preferably fire retardant and heat resistant. The weight of the leather is preferably 3.25 to 4.0 ounces leather. Other materials may also be used to make shell 12 as desired by one of skill in the art. The completed insert 14 and shell 12 are interconnected at stitching 16 around the wrist, as shown in FIG. 19, as well at stitching between end of tabs (not shown) to shell 12 while shell 12 is inverted. The left hand glove is formed in like manner.

In another embodiment, the glove is formed in the same manner except that after the adhesive sealant has been applied and cured and before the tabs are applied to the glove insert 14, the completed insert 14 is reversed again, i.e. turned inside out. This reversal places the barrier 20*a* on the inside, the inner liner 20*b* on the outside, the protruding stitching seams on the outside and the seam sealed elongated peripheral seam depression 62 on the inside of the glove insert 14. The adhesive tabs are then applied to both ends of each finger and thumb portions of the completed insert 14. A portion of the adhesive tabs extends from the end of each finger and thumb portions allowing the tabs to be attached to shell 12 by stitching. The completed insert 14 is inserted into shell 12 and interconnected together at stitching 16 around the wrist, as shown in FIG. 19, as well at stitching between end of tabs (not shown) to shell 12 while shell 12 is inverted. The left hand glove is again formed in like manner.

It is conceivable that certain minor variations in the technology set forth herein may be made to suit a particular type of material or layered assembly. The invention is intended to be limited only by the scope of the appended claims and the reasonable equivalents thereto.

We claim:

1. A method of making a glove comprising:

(a) providing trank, forchette and thumb glove components, each having an inner liner and a barrier adhered to said inner liner; and providing a glove shell;

(b) stitching said components together with said inner liner on the outside and said barrier on the inside to form an assembled glove insert system having protruding connecting seams between said components at the outer periphery of said insert system;

(c) reversing said glove insert system to place said inner liner inside, said barrier outside, and said protruding seams inside, while creating elongated peripheral depressions along the exterior of said seams;

(d) applying a primer base along said peripheral depressions of said seams, wherein said primer base comprises a plurality of solvents, tetrapropyl orthosilicate and tetra (2-methoxyethoxy) silane;

(e) applying an adhesive sealant along said peripheral depressions of said seams, and curing said adhesive sealant thereby sealing said seams to prevent liquid, chemical and viral ingress thereat while said barrier allows moisture vapor egress; and (f) securing said reversed glove insert system inside said glove shell.

2. The method of claim 1 wherein said inner liner comprises a fleece layer.

3. The method of claim 1 wherein said reversed glove insert system is stitched to said glove shell.

4. The method of claim 1 wherein said plurality of solvents comprises: light aliphatic petroleum solvent naptha, xylene and ethylbenzene.

5. The method of claim 1 wherein said step (e) said adhesive sealant is applied as a bead spread along said peripheral depressions of said seams.

6. A glove comprising:

an outer shell and an inner member system, said inner member system comprising an inner liner and an outer barrier adhered to said inner liner, said inner liner and said barrier attached together along peripheral seams; said seams being inverted with the stitching on the inside of said inner member system and an elongated recess along the outside periphery; and a primer base in said elongated recess along said seams on the outside of said inner member system; and an adhesive sealant in said elongated recess along said seams on the outside of said inner member to prevent liquid, chemical and viral ingress thereat while said barrier allows moisture egress.

7. The glove of claim 6 wherein said primer base comprises a plurality of solvents, tetrapropyl orthosilicate and tetra (2-methoxyethoxy) silane.

8. The glove of claim 7 wherein said plurality of solvents comprises: light aliphatic petroleum solvent naphtha, xylene and ethylbenzene.

9. A method to prevent liquid, chemical and viral ingress to a glove or other article having an outer shell and an inner member system, said inner member system comprising a liner and a barrier adhered to said liner, said liner and said barrier attached together along peripheral seams, said seams being inverted with the stitching on the inside of said inner member system and an elongated recess along the outside periphery, said method comprising:

(a) applying a primer base along said elongated recess, wherein said primer base comprises a plurality of solvents, tetrapropyl orthosilicate, and tetra (2-methoxyethoxy) silane, and drying said primer base; and (b) applying an adhesive sealant along said elongated recess, and curing said adhesive sealant thereby sealing said seam to prevent liquid, chemical and viral ingress thereat.

10. The method of claim 9 wherein said plurality of solvents comprises: light aliphatic petroleum solvent naphtha, xylene and ethylbenzene.

11. A method of making a glove comprising:

(a) providing trank, forchette and thumb glove components, each having a liner and a barrier adhered to said liner; and providing a glove shell;

(b) stitching said components together with said liner on the outside and said barrier on the inside to form an assembled glove insert system having protruding connecting seams between said components at the outer periphery of said insert system;

(c) reversing said glove insert system to place said liner inside, said barrier outside and said protruding seams inside, while creating elongated peripheral depressions along the exterior of said seams;

(d) applying a primer base along said peripheral depressions of said seams, wherein said primer base comprises a plurality of solvents, tetrapropyl orthosilicate and tetra (2-methoxyethoxy) silane;

(e) applying an adhesive sealant along said peripheral depressions of said seams, and curing said adhesive sealant thereby sealing said seams to prevent liquid, chemical and viral ingress thereat while said barrier allows moisture vapor egress;

(f) reversing said glove insert system to place said liner outside, said barrier inside, said protruding seams outside and said seam sealed peripheral depressions inside; and (g) securing said glove insert system inside said glove shell.

12. The method of claim 11 wherein said liner comprises a fleece layer.

13. The method of claim 11 wherein said glove insert system is stitched to said glove shell.

14. The method of claim 11 wherein said plurality of solvents comprises: light aliphatic petroleum solvent naphtha, xylene and ethylbenzene.

15. The method of claim 11 wherein said step (e) said adhesive sealant is applied as a bead spread along said peripheral depressions of said seams.

16. A glove comprising:

an outer shell and an inner member system, said inner member system comprising a liner and a barrier adhered to said liner, said liner and barrier being attached together along peripheral seams; said seams being inverted with the stitching on the inside of said inner member system and an elongated recess along the outside periphery in order to apply a primer base and an adhesive sealant; said primer base applied in said elongated recess along said seams on the outside of said inner member system; said adhesive sealant applied in said elongated recess along said seams on the outside of said inner member system to prevent liquid, chemical and viral ingress thereat while said barrier allows moisture egress; and said seams being inverted with the stitching on the outside of said inner member and said elongated recess along the inside periphery.

17. The glove of claim 16 wherein said primer base comprises a plurality of solvents, tetrapropyl orthosilicate and tetra (2-methoxyethoxy) silane.

18. The glove of claim 16 wherein said plurality of solvents comprises: light aliphatic petroleum solvent naphtha, xylene and ethylbenzene.

19. The method of claim 1 wherein said barrier is made of porous polytetrafluroethylene.

20. The method of claim 11 wherein said barrier is made of porous polytetrafluroethylene.

* * * * *